US005229681A

United States Patent [19]

Gordin et al.

[11] Patent Number: 5,229,681

[45] Date of Patent: Jul. 20, 1993

[54] DISCHARGE LAMP WITH OFFSET OR TILTED ARC TUBE

[75] Inventors: Myron K. Gordin; Jim L. Drost, both of Oskaloosa, Iowa

[73] Assignee: Musco Corporation, Oskaloosa, Iowa

[21] Appl. No.: 882,365

[22] Filed: May 6, 1992

. Related U.S. Application Data

[63] Continuation of Ser. No. 419,018, Oct. 10, 1989, abandoned.

[51] Int. Cl.[5] ..... H01J 61/30; H01J 61/34; H01J 9/24

[52] U.S. Cl. ..... 313/25; 313/113; 445/26

[58] Field of Search ..... 313/25, 113; 445/26

[56] References Cited

U.S. PATENT DOCUMENTS

| | | | |
|---|---|---|---|
| 1,639,753 | 8/1927 | Shelton . | |
| 1,961,719 | 6/1934 | Uyterhoeven | 313/25 |
| 2,152,989 | 4/1939 | Ewest et al. | 313/25 |
| 2,904,710 | 9/1959 | Beeninga et al. | 313/25 |
| 3,281,620 | 10/1966 | Miller | 313/113 |
| 3,511,985 | 5/1970 | Muscovitch . | |
| 3,626,229 | 12/1971 | Spacil et al. | 313/25 |
| 3,882,346 | 5/1973 | McVey | 313/25 X |
| 4,142,122 | 2/1979 | Koza . | |
| 4,221,989 | 9/1980 | Van Lieshout | 313/25 X |
| 4,229,673 | 10/1980 | McAllister | 313/25 X |
| 4,341,975 | 7/1982 | Phillipp et al. | 313/25 |
| 4,410,828 | 10/1983 | Ernest | 313/25 |
| 4,422,004 | 12/1983 | Knecht | 313/25 |
| 4,428,039 | 1/1984 | Guimond et al. | 362/287 |
| 4,521,834 | 6/1985 | Orr | 362/139 |
| 4,548,449 | 10/1985 | Corsetti | 339/154 |
| 4,610,498 | 9/1986 | Thomas | 339/186 R |
| 4,626,734 | 12/1986 | Greiler | 313/113 X |
| 4,687,453 | 8/1987 | Lekebusch et al. | 445/4 |
| 4,722,711 | 2/1988 | Lekebusch et al. | 445/64 |
| 4,799,135 | 1/1989 | Inukai et al. | 313/113 X |
| 4,935,668 | 6/1990 | Hansler et al. | 313/113 X |
| 4,990,819 | 2/1991 | Narby et al. | 313/25 |
| 5,016,150 | 5/1991 | Gordin et al. . | |

FOREIGN PATENT DOCUMENTS

| | | | |
|---|---|---|---|
| 860671 | 12/1952 | Fed. Rep. of Germany . | |
| D17440 | 12/1956 | Fed. Rep. of Germany . | |
| 16959 | 5/1972 | Japan | 313/631 |
| 0132375 | 10/1979 | Japan . | |
| 53058 | 3/1982 | Japan . | |
| 2103959 | 5/1987 | Japan | 313/25 |
| 0136747 | 6/1987 | Japan | 313/25 |
| 1562929 | 3/1980 | United Kingdom | 313/25 |

OTHER PUBLICATIONS

"A New Generation of Metal Halide Lamps", *Journal of the Illuminating Engineering Society*, vol. 4, No. 2, pp. 106–110, Jan. 1975.

Venture Lighting International, Pro-Arc Professional Metal Halide Lamps for General Lighting, Brochure (date unknown).

*Primary Examiner*—Palmer C. Demeo

*Attorney, Agent, or Firm*—Zarley, McKee, Thomte, Voorhees & Sease

[57] ABSTRACT

A discharge lamp with offset or tilted arc tube includes a glass envelope or bulb which surrounds an arc tube. One end of the bulb has a threaded mount for securement into a lamp socket. The arc tube is supported inside the bulb in a position whereby the longitudinal axis of the arc tube is offset from the longitudinal axis of the bulb.

14 Claims, 2 Drawing Sheets

DISCHARGE LAMP WITH OFFSET OR TILTED ARC TUBE

This is a continuation of copending application(s) Ser. No. 07/419,018 filed on Oct. 10, 1989, now abandoned.

BACKGROUND OF THE INVENTION a) Field of the Invention

The present invention relates to high-intensity discharge lamps, and particularly, to high-intensity mercury and metal halide lamps.

b) Problems in the Art

High-intensity discharge or arc lamps such as mercury lamps, and metal halide lamps represent an efficient, high-intensity source of light, particularly for high-intensity, large quantity, or large area of lighting. There are different types of arc lamps in general, and mercury and metal halide arc lamps in particular, such as are available from a wide variety of manufacturers and distributors.

Conventional lamps of this type generally consist of a mounting apparatus, such as a screw-end or threaded end, an arc tube, electrical connections connected between the screw-end and the arc tube, and a glass jacket, outer envelope, or bulb surrounding the arc tube and at least some of the electrical connections.

As can be appreciated, and as is known to those of ordinary skill in the art, the arc tube is generally an elongated envelope made of quartz or some other high-temperature resistant yet substantially transparent material. The arc tube thus generally has a longitudinal axis which is generally aligned along the longitudinal axis of the entire arc lamp, which in the case of an arc lamp with a threaded end, extends between the screw-end and the opposite end of the lamp.

The arc tube is generally evacuated of air and is loaded with chemicals, including mercury or metal halides in mercury and metal halide lamps, which facilitate creation of a high-intensity light discharge arc between electrodes which extend into the arc tube, when electricity is applied to the electrodes. The bulb is also usually evacuated to provide temperature insulation and to provide protection to the arc tube.

Because the arc tube of such conventional arc lamps is aligned along the longitudinal axis of the arc lamp, the lighting characteristics of these conventional arc lamps are somewhat uniform. Most of the light emanating from such an arc tube does so laterally (perpendicularly from the longitudinal axis), with a much less significant amount of light emanating from the arc tube's opposite ends. The light pattern which is emitted from these conventional arc lamps, while being somewhat consistent between conventional arc lamps, does lack flexibility and can present limitation as to the light pattern radiated from the lamp.

In most lighting applications, reflectors or reflecting elements are utilized to alter the light pattern emanating from the lamp. Hemispherical reflectors which are symmetrical around the longitudinal axis of the arc lamp are a conventional choice. The arc lamp is screwed into a socket and seats within the reflector so that its outer end points to the lighting target. Therefore, a substantial amount of the light emanating from the lamp and reflector combination is reflected light originally emanating from the sides of the arc tube, gathered in the reflector, and then redirected.

It is well known that direct light is more efficient than reflected light. Any reflection results in some light loss. A conventional arc lamp having the arc tube aligned along the lamp's longitudinal axis, and positioned in a conventional symmetrical reflector, results in a significant amount of light loss.

Furthermore, there is an effect which is known as "tilt factor" which can reduce the efficacy (lumens per watt) of metal halide or mercury arc lamps. An arc lamp operates with the highest efficacy when the arc tube is positioned vertically. The next best positioning of an arc tube as far as efficacy is concerned would be when the arc tube is horizontal. High temperatures during operation of an arc lamp cause evaporation of chemicals within the arc tube which in turn causes the gas discharge which emits light. If there is uneven heating within the arc tube, which renders some locations sufficiently cooler from others, the efficacy of the lamp will decrease. Chemicals may condense out blocking light from emanating from the arc tube. Precipitation of these essential chemicals also means that they will not be discharging light.

Therefore, traditionally, these arc lamps have been desired to be installed and operated in a directly vertical fashion. Since the arc tube is aligned along the longitudinal axis of the lamp, and the aiming axis of the lamp is vertical, optimal efficacy is achieved. U.S. Pat. No. 4,341,975, by Phillipp, et al., entitled "Jacketed Lamp Having Transversely Mounted Arc Tube", issued Jul. 27, 1982, discusses this phenomenum. In that patent, it is recognized that arc lamps are not always desired to be positioned in a directly vertical orientation. The Phillipp patent therefore presents a method by which the bulb of the arc lamp can be positioned horizontally, and yet the arc tube itself is positioned vertically for optimal efficacy.

In many lighting applications, however, the aiming direction of the arc lamp is other than completely vertical or completely horizontal. In those conditions, a conventional mercury or metal halide arc lamp with the arc tube aligned along the longitudinal axis, loses efficacy. Because heat rises, tilting of the arc tube between horizontal and vertical (in any direction), will cause hotter areas to develop at the highest point of the arc tube, generally along the top of the arc tube. In turn, cooler areas will develop at the lowest points, generally along the lower part of the arc tube. These temperature differences, even though the overall temperature through and surrounding the arc tube is quite high, can cause precipitation of some of the loaded chemicals inside the arc tube. Such precipitation will cause clouding and blockage of light, and of course, will also make less chemical available for production of the arc stream, which will also contribute to a reduction in the amount of light possible from the arc lamp. Other detrimental results can be drops in wattage of the lamp of, for example, three or four percent, and pressure changes in the lamp; all of which can adversely affect the consumption of power by the lamp, making it less efficient and less economical.

This problem is called the "tilt factor". If a conventional mercury or metal halide arc lamp is tilted below horizontal, generally between 0° and 45° below horizontal, the tilt factor results in light output loss of up to 20%.

Therefore, there is a lack of flexibility in such arc lamps having the arc tube aligned directly along the longitudinal axis of the arc lamp. Furthermore, conventional such arc lamps suffer from the tilt factor, which can produce serious efficiency and efficacy problems.

It is therefore a principal object of the present invention to provide a tilted arc discharge lamp which can increase efficacy or light output, efficiency, and flexibility of use of an arc lamp to improve upon or solve deficiencies and problems in the art.

A further object of the present invention is to provide a lamp as above described with respect to mercury and metal halide lamps which can be utilized to solve tilt factor problems, light direction problems and other lighting deficiencies or limitations.

A further object of the present invention is to provide a lamp as above described which can be utilized in existing bulbs or glass jackets and screw-in mounts.

Another object of the present invention is to provide a lamp as above described which can be advantageously combined with reflector assemblies to increase the amount of light and allow improved flexibility in directing light.

A further object of the present invention is to provide a lamp as above described which is efficient, and economical to manufacture, install, and maintain.

These and other objects features and advantages of the present invention will become more apparent with reference to the accompanying drawings and specification.

SUMMARY OF THE INVENTION

The present invention consists of a conventional glass envelope, outer jacket, or bulb, with a conventional screw-in threaded mount. A conventional arc tube has connections adapted for operative connection to electrical power, such as is known in the art. The arc tube inside the bulb is, however, tilted or offset from the longitudinal axis of the arc lamp. By moving the arc tube off of the longitudinal axis, significant changes in the light pattern emanating from the arc lamp are achieved. For example, more direct light would emanate from the front of the bulb, than when the arc tube is aligned along the longitudinal axis, if the arc lamp is angularly tilted from the longitudinal axis of the arc lamp.

The tilt or offset from the longitudinal axis can be of any degree. The amount can be selected to achieve various effects.

Furthermore, the tilting or offset can drastically change the operation of the arc lamp when used in conjunction with a reflector. Because the emanating light pattern from either an offset or a tilted arc tube is different from conventional lamps, different composite light output from the tilted arc lamp and reflector will be achieved. Depending on the position of the arc tube and the type of reflector, a greater amount of light can be directly sent to the target area. Additionally, a greater amount of light may be able to be captured and reflected by the reflector to the target area, rather than having it be misdirected or spilled into areas out of the target area.

Still further, the tilt or offset of the arc lamp can be matched with the angled orientation of the arc lamp so that the arc tube can be horizontally or vertically positioned to reduce any tilt factor in mercury or metal halide lamps. In other words, if the longitudinal axis of the lamp, when installed, is 50° up from vertical, the arc tube can be tilted from that longitudinal axis 40° so that it is generally horizontal. Although the aiming axis of the bulb would be angled downwardly, the arc tube would be horizontal, more light would directly emanate along the aiming axis of the bulb, and any tilt factor would be greatly reduced. Alternatively, the arc tube could be tilted off the longitudinal axis of the arc lamp so that it is operated in a vertical orientation, even though the arc lamp is not vertically oriented.

DETAILED DESCRIPTION OF THE PREFERRED EMBODIMENT

Figure 1:
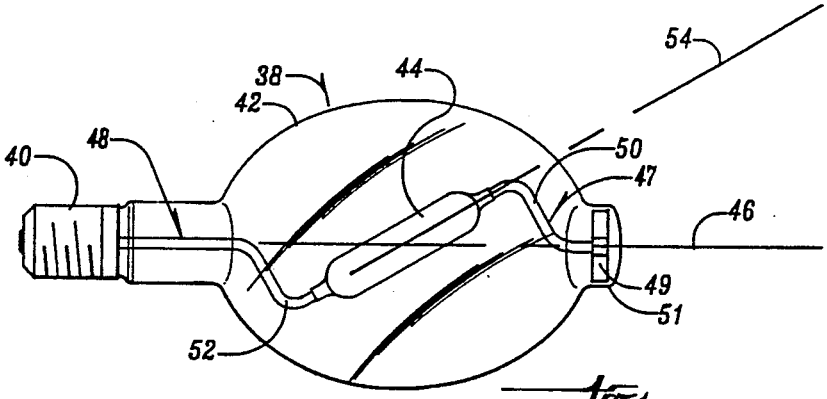
FIG. 1 is a side view showing one embodiment of the invention where the arc tube is tilted from the longitudinal axis of the arc lamp.

With reference to the drawings, the preferred embodiment of the invention will be described. In the drawings, parts or elements will be referred to by reference numerals.

With particular reference to FIG. 1, an arc lamp 38 is depicted. Arc lamp 38 has a conventional threaded mount 40, a conventional glass envelope or bulb 42, and a tilted arc tube 44 enclosed within bulb 42. As can be seen, arc tube 44 is tilted with respect to longitudinal axis 46 of arc lamp 38.

FIG. 1 also depicts the electrical connections 47, 48 which support tilted arc tube 44 within bulb 42. Electrical connection 47 has an angled portion 50 connected to one end of arc tube 44, and electrical connection 48 has an angled portion 52 connected to the other end of arc tube 44. Line 54 depicts the longitudinal axis of arc tube 44. Axis 54 is thus angularly pivoted and tilted from, yet generally intersects, axis 46.

In the preferred embodiment, arc lamp 38 is a metal halide gas discharge lamp or HID lamp. Such lamps are available from a wide variety of manufacturers including Philips Lighting, General Electric, Sylvania, Venture Lighting International, etc. U.S. Pat. No. 4,341,975, previously mentioned, shows the specifics of one way of mounting an arc tube within an arc lamp, including the electrical connections. Such electrical connections are well known in the art and will not be described in detail, other than they can be made of sufficient materials to both supply electric potential to opposite sides of the arc tube of quite high power levels, and at the same time support the arc tube.

In the preferred embodiment of the invention, electrical connection 47 provides the support of the arc tube 44 with the assistance of an attached front spring-loaded clip 49 which seats within the nose 51 of bulb 42. Another spring-loaded clip (not shown) could be attached to electrical connection 48 to assist in supporting that end of arc tube 44.

Figure 2:
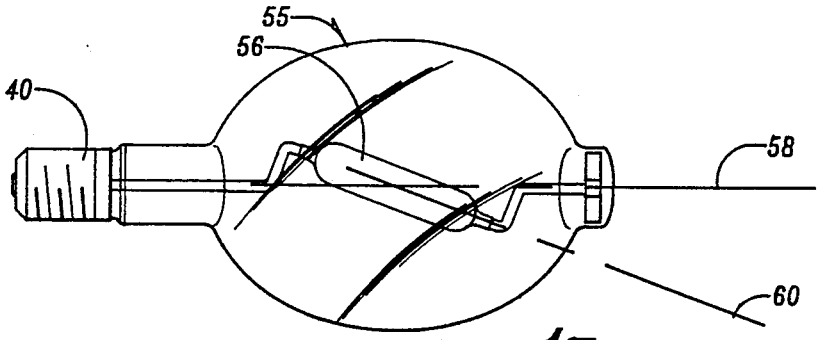
FIGS. 2 and 3 are similar side views showing different amounts of tilt of the arc tube from the longitudinal axis of the arc lamp.
Figure 3:
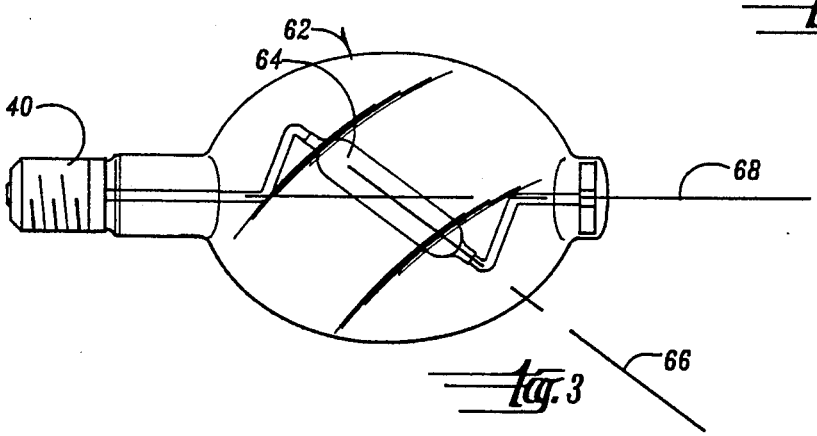

FIG. 2 shows an arc lamp 55 with an arc tube 56 having a longitudinal axis 58 offset in the sense it is tilted from arc lamp axis 60. It can be seen that arc tube 56 is tilted at a smaller angle than that which is shown in FIG. 1, and in an opposite direction. By further example, FIG. 3 shows arc lamp 62 having arc tube 64 with longitudinal axis 66 tilted from axis 68 of lamp 62. In this embodiment, the tilt of arc tube 64 is greater than that shown in FIGS. 1 or 2.

It is to be understood that in the broadest sense, the arc tubes can be offset from the longitudinal axis of the arc lamp in any direction and orientation. In some applications it may be desired that the arc tube be tilted upwardly or downwardly with respect to the longitudinal axis and the front of the bulb to obtain some sort of a directional orientation of the arc tube for a specific lighting effect. Additionally, the arc tube does not have to be centrally or otherwise pivoted on the longitudinal axis of the arc lamp, but can be offset and/or tilted in other orientations to the lamp's axis.

Figure 4:
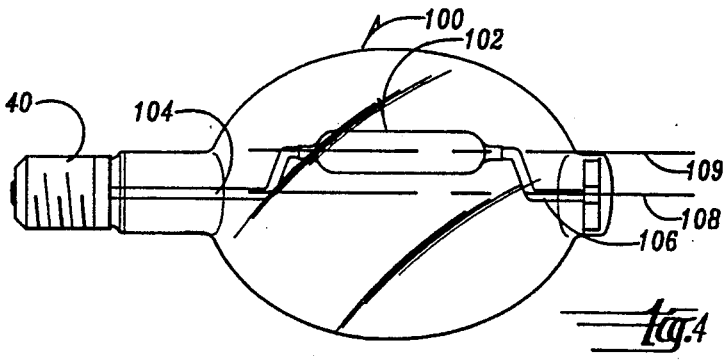
FIG. 4 is a similar side view showing an arc tube offset so that its longitudinal axis is generally parallel to the longitudinal axis of the arc lamp.

For example, FIG. 4 shows an arc lamp 100 having a longitudinal axis 108. Arc tube 102, having a longitudinal axis 109, is offset from lamp longitudinal axis 108 in such a manner by connections 104 and 106 that arc tube axis 109 is generally parallel to lamp axis 108. This differs from the embodiments of 1–3 in that arc tube 102 is not tilted with respect to axis 108, but is offset. This offset would produce beam pattern from lamp 100 which differs from conventional lamp where the arc tube would be aligned directly along axis 108.

Figure 5:
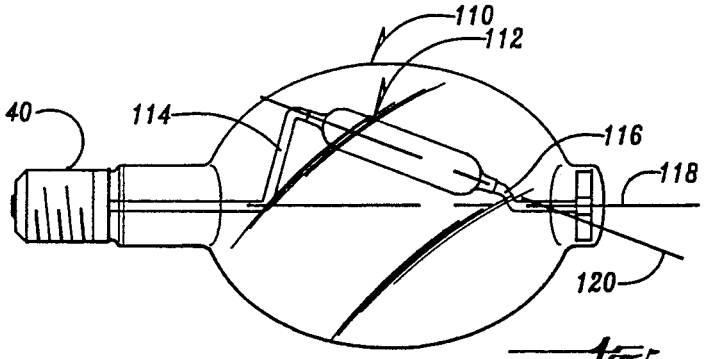
FIG. 5 is a similar side view showing an arc tube both completely offset from and tilted with respect to the longitudinal axis of the arc lamp.

As a further example, FIG. 5 shows an arc lamp 110 having a longitudinal axis 118 where arc tube 112 is positioned by mounts 114 and 116 so that it is both completely offset from longitudinal axis 118, as well as tilted with respect to longitudinal axis 118, as highlighted by line 120 which depicts the longitudinal axis of arc tube 112. The arc lamp can be mounted in any number of configurations where the arc tube is offset from the longitudinal axis of the arc lamp. The longitudinal axis of the arc tube may or may not intersect the longitudinal axis of the arc lamp, and may or may not be tilted with respect to the lamp's longitudinal axis. The embodiments of FIGS. 1–5 therefore give but a few examples of how the arc tube can be offset from the longitudinal axis of the arc lamp.

If reduction of the tilt factor in mercury or metal halide lamps is a primary goal, the arc tube can be pivoted and tilted from the longitudinal axis of the arc lamp (if the arc lamp is being operated in anything but a horizontal or vertical position) so that the arc tube ends up in at least a generally horizontal or vertical position even though the lamp itself is not horizontal or vertical in orientation.

Figure 6:
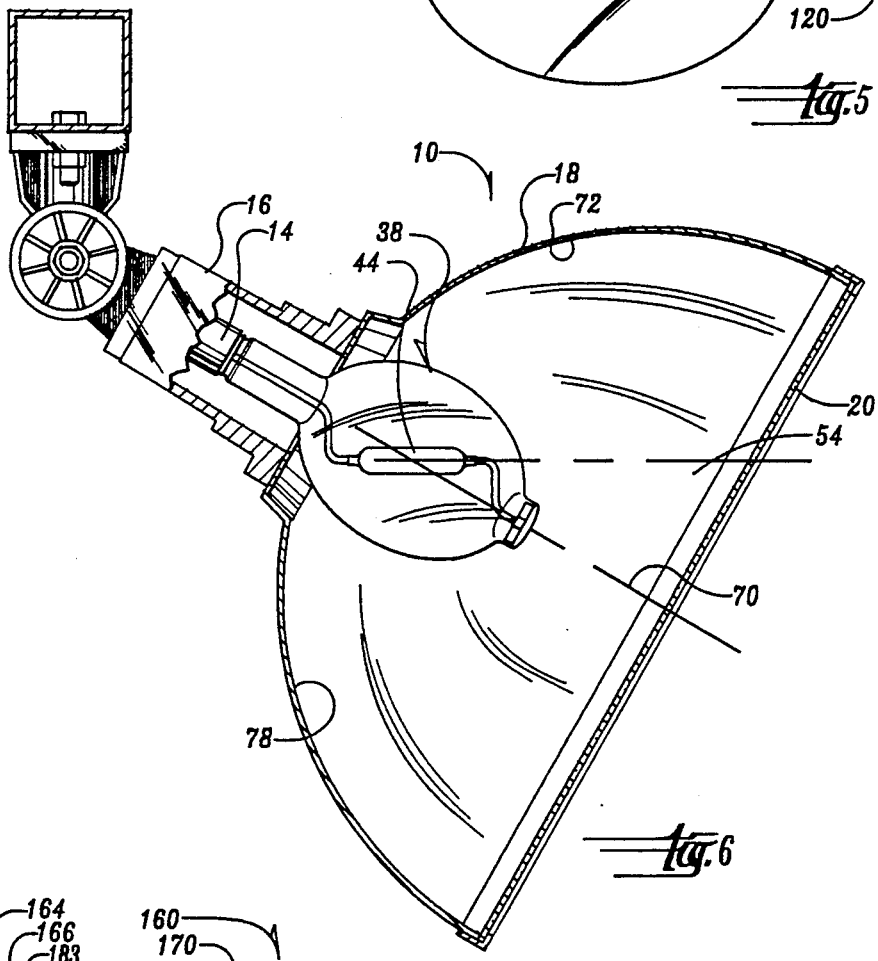
FIG. 6 is a partial sectional, partial cutaway side elevational view of the tilted arc discharge lamp, according to the invention, mounted in a conventional reflector assembly.

FIG. 6 utilizes arc lamp 38 of FIG. 1, threadably mounted into conventional socket 14 of conventional bulb cone 16. Conventional symmetrical reflector 18 is also utilized. As can be seen, longitudinal axis 54 of arc tube 44 is generally horizontal. However, line 70, which represents both the longitudinal axis of arc lamp 38, and the aiming direction or reflector axis of the entire fixture, is angularly offset from axis 54 downwardly to a target area. It is to be understood that line 70 and axis 54 are generally in the same vertical plane. It can therefore be seen that the embodiment of FIG. 4 holds arc tube 44 in a generally horizontal position to minimize tilt factor, and yet utilizes a conventional mounting fixture and reflector to direct light to the target area.

As can be easily understood, if it were desired to have arc tube 44 of arc lamp 38 in FIG. 6 to be vertical to reduce tilt factor, arc tube 44 could be prepared in that manner. It is to be further understood that with arc lamps, such as shown, having threaded mounts, the arc lamps can be rotated into socket 14 until the correct angular orientation of arc tube 44 is achieved. Alternatively, means can be associated with socket 14, or threaded mount 40 of lamp 38, to ensure that the correct desired orientation of arc lamp 44 can be maintained during operation of the lamp. It is to be also understood that if arc tube 44 is angled with respect to the longitudinal axis of the lighting fixture, rotation of the arc lamp within socket 14 allows fine tuning of the position of arc tube 44 so that almost perfectly horizontal or vertical positioning can be achieved.

It is to be appreciated that bulbs 55 and 62 (or other bulbs with arcs at desired offsets or tilts) could also be utilized in fixture 10, depending on the desired composite light output from the fixture. The configuration of the arc lamps of the present invention allows easy retrofitting to existing fixtures. All that would be required would be to replace conventional arc lamps with the tilted arc discharge lamps.

Referring again to FIG. 6, it is to be understood that because most of the light radiates laterally from the longitudinal axis 54 of arc tube 44, a substantial amount of light would pass directly through reflector lens 20 down to the target area. A substantial amount of light would also be captured and reflect off the top hemisphere 72 of the interior of reflector 18 down to the target area.

A lesser amount of light would radiate directly from either end of arc tube 44. A lesser amount of light would then be reflected from lower hemisphere 78 of the interior of reflector 18.

It can therefore be appreciated that the invention of FIG. 6 contributes to the advantages of increased light output to the target area, increased efficiency, reduction in any tilt factor, and can assist in glare control, all according to selection of the degree of tilt of the arc tube, and its position within a fixture.

The present invention therefore allows significant flexibility in creating different light output patterns, and enables ways to make the arc lamp more efficient with higher efficacy. The invention can also contribute, in certain circumstances to longer lamp life and better lumen maintenance because of reducing hot spots and colder areas in the arc tube.

Figure 7:
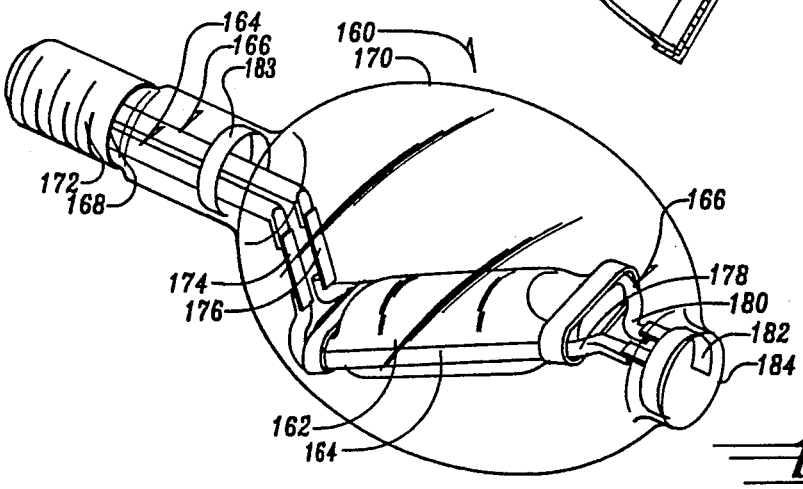
FIG. 7 is a perspective view of an embodiment of the invention additionally showing flexible mounting structure for the arc tube.

FIG. 7 depicts a lamp 160 according to the present invention having an arc tube 162 which is tilted from the longitudinal axis of lamp 160. FIG. 7 shows the structure for mounting arc tube 162 in a tilted position, and yet allows it to be inserted through the narrow neck opening 168 of bulb 170. In this embodiment, electrical power would be connected to arc tube 162 by conventional means (not shown) such as is known in the art. Support for the tilted arc tube 162 would be accomplished by first and second support rods 164 and 166 which extend from threaded screw mount or base 172 through opening 168, parallelly along opposite sides of arc tube 162 out to spring clip 182, which securely seats within nose 184 of bulb 170. Another spring clip 183, attached to rod 166, could be positioned in the neck of bulb 170 to assist in supporting the structure. The clips are configured and mounted so as not to short out any electrical connections to arc tube 162.

Rods 164 and 166 are bent so that when clip 182 is positioned in nose 184, clip 183 is positioned in the neck of bulb 170, and the opposite ends of rods 164 and 166 are secured in base 172, arc tube 162 is held in the desired angular position. As can easily be understood, the tilt or offset of arc tube 162 can vary according to desire. In the preferred embodiment, the tilt from longitudinal axis of the bulb can be between 20° and 45°.

To facilitate the insertion of arc tube 162 into arc lamp 160 during assembly, support rods 164 and 166 can have narrow portions or flat springs 174, 176 and 178, 180 along their lengths on opposite sides of arc lamp 162. These narrowed portions assist the sections of support rods 164 and 166 to be resiliently flexed to allow insertion of the entire assembly into bulb 170. Once inserted and properly seated, the narrowed sections are resilient and rigid enough to hold the arc tube 162 in its desired position.

Flat springs 164 and 166 have therefore been incorporated into support rods 164 and 166 on one side of arc tube 162. Flat springs 178 and 180 have likewise been so incorporated on the other side of arc tube 162 directly adjacent the c-shaped spring or clip 182 which allows mounting of the arc tube 162 in the front of bulb 170.

The flat springs 174, 176, 178, and 180 allow flexing of rods 164 and 166 so as to flatten out rods 164 and 166. This, in turn, allows arc tube 162 and supporting structure to be inserted through opening 168. Upon complete entry into bulb 170, the flat springs return the arc tube 162 to its tilted attitude.

This arrangement allows insertion and assembly of those types of arc lamps, utilizing bulbs with openings of fixed diameters, such as are used in the art. This is particularly useful if the amount of arc tilt is such that conventional insertion methods will absolutely not work.

The arrangement of FIG. 7 has further advantages. First, the arrangement of rods 164 and 166 rigidly and adequately supports arc tube 162 so that its precise location during use is ensured. Secondly, springs 174, 176, 178 and 180 provide sufficient rigidity, yet also have flexibility and shock absorption to inhibit breakage or damage during shipment or use. Third, this arrangement allows arc tube 162 to be tilted at significant angles from the center longitudinal axis of lamp 160 which contributes to increased yield of light, as previously explained, diminution of tilt factor, as previously explained; while still enabling flexible insertion into the bulb 170 during manufacturing and assembly.

The embodiment of FIG. 7 therefore shows a method and structure to allow significant tilting of arc tube 162 while at the same time allowing flexion of the support rods 164 and 166 efficiently to allow insertion into bulb 170.

It will be appreciated that the present invention can take many forms and embodiments. The true essence and spirit of this invention are defined in the appended claims, and it is not intended that the embodiment of the invention presented herein should limit the scope thereof.

What is claimed is:

1. An arc lamp comprising:

an arc lamp envelope having a longitudinal axis and first and second ends generally along the longitudinal axis;

a connection generally at the second end of the envelope allowing mounting of the arc lamp in a fixture;

an arc tube enclosed in the envelope and having a longitudinal axis and first and second ends, the longitudinal axis of the arc tube tilted with respect to the long axis of the arc lamp;

at least one mounting rail extending generally between the first and second ends of the arc lamp envelope, end portions of the rail extending generally parallel to the long axis of the arc lamp envelope, an intermediate portion extending generally along and parallel to the long axis of the arc tube, and first and second connecting portions between each end portion and opposite ends of the intermediate portion;

the connecting portions including resilient members to allow a resilient range of flexure of the rail to facilitate insertion of the arc tube into the arc lamp envelope and to dampen shock to the arc tube once inserted.

2. The arc lamp of claim 1 wherein the envelope has an enlarged portion and a relatively narrow neck at its first end, and the neck having a diameter.

3. The arc lamp of claim 1 wherein the connection comprises a screw mount means.

4. The arc lamp of claim 1 wherein the arc tube is elongated along its longitudinal axis.

5. The arc tube of claim 1 wherein the mounting rail is positioned along the one side of the arc tube.

6. The arc lamp of claim 1 further comprising securing means at the first and second ends of the arc tube to secure the arc tube to the mounting rail.

7. The arc lamp of claim 1 further comprising a pair of mounting rails generally at opposite sides of the arc tube.

8. The arc lamp of claim 2 further comprising securing means at the first and second ends of the arc tube to secure the arc tube to the mounting rail.

9. The arc lamp of claim 2 wherein the arc tube is tilted at an angle in the range of 30° plus or minus 15°.

10. The arc lamp of claim 9 wherein the length of the connecting portion between the second end and the intermediate portion is greater than the diameter of the neck.

11. The arc lamp of claim 1 wherein the resilient members comprise flat spring means.

12. The arc lamp of claim 1 wherein the resilient members comprise flattened portions of the rail member.

13. A method of maintaining an arc tube at a substantial angle to the long axis of an envelope of an arc lamp comprising:

shaping a generally rigid rail member to have opposite end portions align along a first axis, and an arc tube supporting portion align along a second axis angled to the first axis at a selected angle of tilt with the arc tube;

resiliently connecting the arc tube supporting portion to the opposite end members;

connecting the arc tube to the arc tube supporting portion of the rail member;

inserting an opposite end portion of the rail member into an opening in a neck of a lamp envelope;

flexing the resilient connection between said opposite end portion and the arc tube supporting portion of the rail member, if needed, to pass at least an initial portion of the arc tube through the neck;

flexing the resilient connection between the other opposite end portion and the arc tube, if needed, to pass any remaining portion of the arc tube and a portion of the other opposite end portion into the arc tube;

allowing the resilient connections to return to original form to orient the arc tube in a desired tilted position to the long axis of the envelope.

14. The method of claim 13 further comprising operatively connecting electrical connection means to the arc tube, securing the rail into the opposite ends of the envelope by support means, closing off the neck opening with a connection means to produce a completed arc lamp, the resilient connections dampening any shock or vibration to the arc tube during shipment or use of the arc lamp.

* * * * *